United States Patent [19]

LaRoche et al.

[11] Patent Number: 4,663,894

[45] Date of Patent: May 12, 1987

[54] FLEXIBLE GUTTER

[75] Inventors: Allan R. LaRoche, Lewiston; Robert A. Butcher, Turner Center, both of Me.; Denis M. Kelleher, Denver, Colo.; Marcel L. M. Corriveau; Jean A. Dubuc, both of Lewiston, Me.

[73] Assignee: Manville Corporation, Denver, Colo.

[21] Appl. No.: 813,288

[22] Filed: Feb. 21, 1986

[51] Int. Cl.[4] ..... E04D 13/04; E04B 1/68

[52] U.S. Cl. ..... 52/15; 52/396; 405/118; 404/68

[58] Field of Search ..... 52/11, 15, 396, 13, 52/14; 405/118, 119; 404/69, 68

[56] References Cited

U.S. PATENT DOCUMENTS

| | | | |
|---|---|---|---|
| 1,061,424 | 5/1913 | Swick | 405/119 |
| 1,982,064 | 11/1934 | Norton | 405/119 |
| 2,572,592 | 10/1951 | Brandt et al. | 52/11 |
| 3,057,117 | 10/1962 | Singer | 52/11 |
| 3,346,941 | 10/1967 | Patry et al. | 52/396 |
| 3,849,958 | 11/1974 | Balzer et al. | 52/396 |
| 4,129,967 | 12/1978 | Barlow | 52/15 |

*Primary Examiner*—John E. Murtagh
*Assistant Examiner*—Caroline D. Dennison
*Attorney, Agent, or Firm*—John D. Lister; Cornelius P. Quinn; Timothy R. Schulte

[57] ABSTRACT

A flexible drainage gutter for use under a horizontal surface having moisture accumulation or leaks under cracks or expansion joints. A flexible, waterproof membrane is attached along its elongated edges to rigid flanges which can be attached to the horizontal surface itself or to support members attached to the surface. The width of the membrane can vary so that the membrane hangs down from the flanges a greater distance downstream than upstream, thereby providing for the slope of the gutter. Alternatively, the wall portions of the flanges, to which the edges of the membrane are attached, can vary in width while maintaining the width of the membrane constant to provide for the slope of the gutter.

12 Claims, 14 Drawing Figures

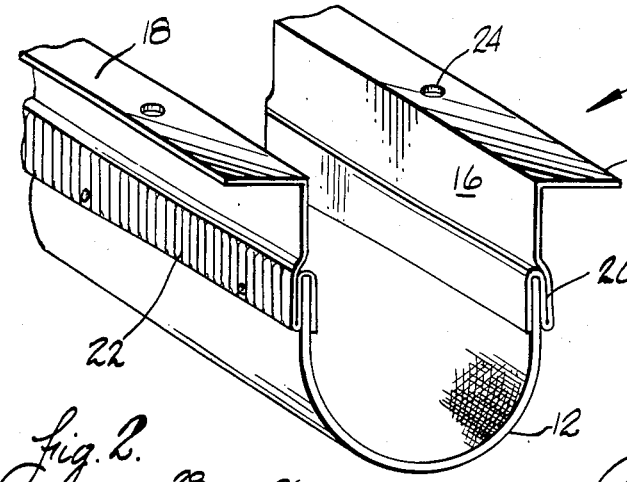
Fig. 1.
Fig. 2.
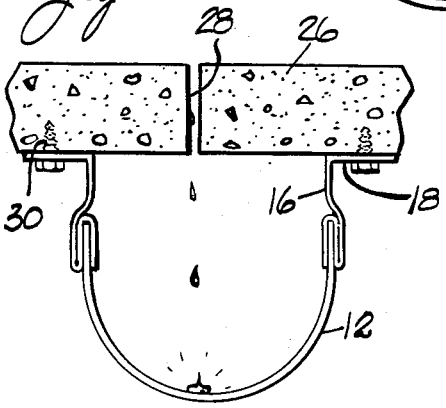
Fig. 5
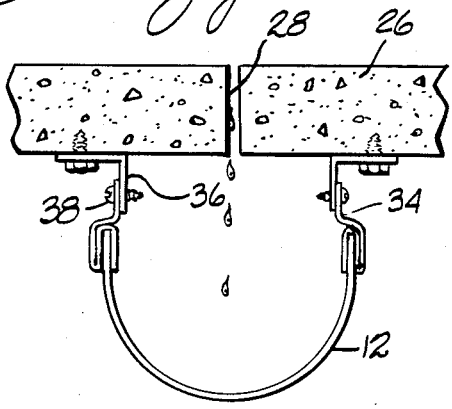
Fig. 3.
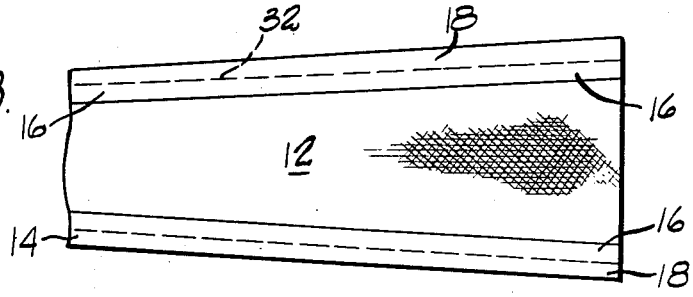
Fig. 4.
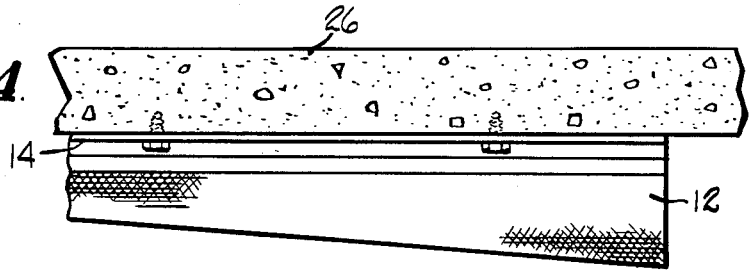

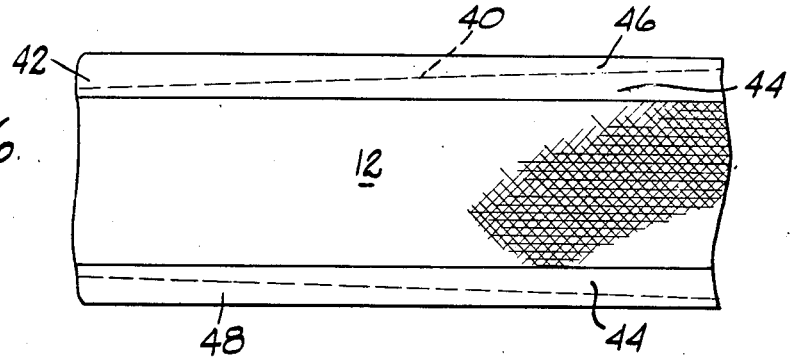
Fig. 6.
Fig. 7.
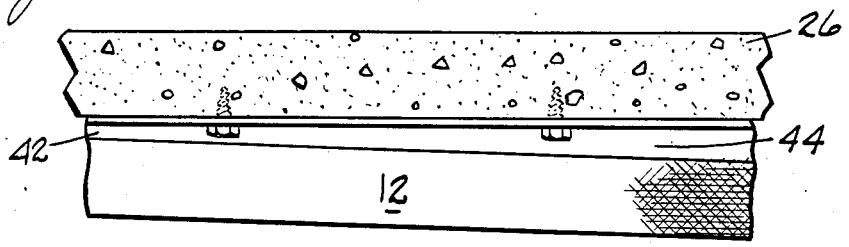
Fig. 9.
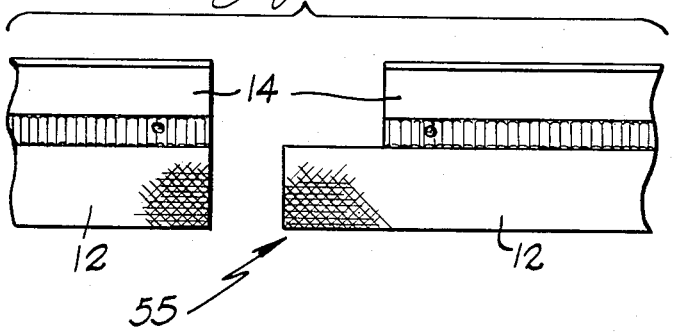
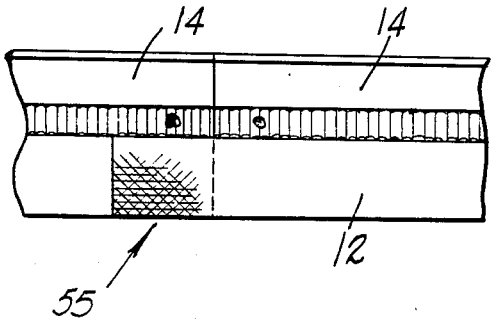
Fig. 10.

FLEXIBLE GUTTER

FIELD OF THE INVENTION

This invention relates to drainage gutters, and more particularly to a flexible drainage gutter capable of use under expansion joints and cracks as well as in other areas of moisture leakage.

BACKGROUND OF THE INVENTION

Leaks often develop in concrete decks, in deck expansion joints and in joints between precast concrete deck elements. In some cases the environment beneath the deck can withstand leakage. In other cases it cannot be tolerated and must be corrected. In the case of a parking garage, for example, where water seeping through a concrete deck is highly alkaline and corrosive to the finish of automobiles, it is necessary to take some corrective measure. The common step of repairing the leak through use of a mastic or sealant has not been found to be a suitable long term solution since the wear and tear of traffic and exposure to the elements very often causes the same problem to arise again. This condition is exacerbated by deck movement from traffic and by normal expansion and contraction of the deck elements. Nor would it be desirable to have to install a new weather resistant surfacing on the upper side of the deck. Not only would the cost be out of proportion to the cost of merely repairing the problem area, but the same wear and tear of traffic and exposure to the elements owuld still tend to cause problems with the new surfacing.

What is needed is a simple, inexpensive yet effective way to correct the problem, heretofore not available.

BRIEF SUMMARY OF THE INVENTION

This invention solves the problem of leakage not by repairing the leak but by providing a simple means for carrying the moisture away. This is preferable to repairing the leak in many cases because quite often the leak is localized due to construction or weather conditions and tends to recur in the same spot, often at an expansion joint, even after it has been repaired. By collecting and diverting the moisture costly repair procedures are obviated. Because of frequently occurring deck movement the use of conventional metal gutters is not acceptable because they cannot withstand the stress and are prone to leakage and failure. Further, the highly alkaline water leaking through a concrete deck, as well as water containing salts often found on the floors of parking garages, tends to corrode metal gutters.

The drainage gutter of this invention utilizes a flexible membrane as the gutter trough, which makes it a simple matter to install, even in areas which do not allow much room for the workmen to maneuver. Rigid flanges attached to the elongated edges of the membrane are used to attach the gutter to the deck. A novel design automatically provides for the desired pitch of the gutter to allow collected moisture to drain away.

Other features and aspects of the invention will be made clear, as well as the various benefits of the invention, in the more detailed description which follows.

BRIEF DESCRIPTION OF THE DRAWING

FIG. 1 is a partial pictorial view of the flexible gutter of the present invention;

FIG. 2 is an end sectional view showing the flexible gutter attached to a concrete slab beneath an expansion joint;

FIG. 3 is a partial plan view of the flexible gutter as it would appear lying flat on a surface prior to the flanges being bent to form the flange shoulders;

FIG. 4 is a partial side view of the flexible gutter of FIG. 3 shown after the flanges have been formed and as it would appear in installed condition;

FIG. 5 is a view similar to that of FIG. 2, but illustrating a modified attachment means;

FIG. 6 is a view similar to that of FIG. 3, but showing a modification of the FIG. 3 design;

FIG. 7 is a view similar to that of FIG. 4, showing the flexible gutter of FIG. 6 in installed condition;

FIG. 9 is a partial side view of opposite end portions of the flexible gutter;

FIG. 10 is a partial side view showing the end portions of FIG. 9 after they have been joined to form a continuous run of the flexible gutter;

DESCRIPTION OF THE INVENTION

Figure 8:
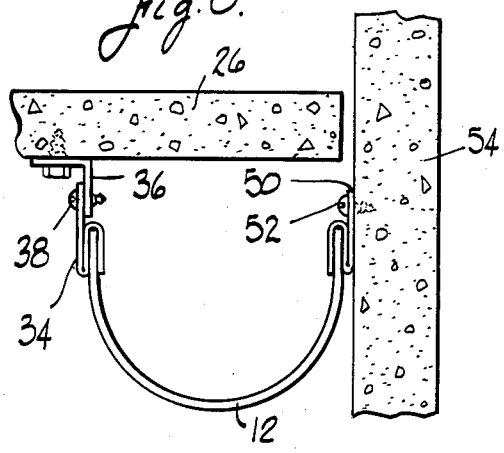
FIG. 8 is an end sectional view showing the flexible gutter attached to a concrete slab and an adjacent wall.

Referring to FIG. 1, the flexible gutter 10 comprises a flexible membrane 12 the elongated edges of which are attached to rigid flanges 14 to form a flexible trough portion depending from the flanges. Any suitable waterproof material may be used as the membrane, such as for example, nioprene, EPDM or TGH (a Tedlar/glass-fiber/Hypalon composite). In practice, a neoprene sheet calendered to 60 mil thickness has been found to function well.

The flange 14 can be formed from any suitable rigid material with adequate strength to support the membrane, and the weight of any collected moisture and to resist any other forces such as wind load and vibrational forces. Stainless steel, for example, in a thickness of 0.018 inch, has been found to perform adequately. As shown, flange 14 is comprised of a wall portion 16 and a shoulder portion 18 extending outwardly from the wall portion at substantially right angles. The membrane edges can be attached to the flanges by any suitable arrangement that results in the membrane being securely gripped and held in place by the flanges, one such arrangement being the metal fold 20 which is crimped at 22 to clamp the membrane within the fold. If desired, spaced prepunched fastener holes 24 can be provided for ease of installation.

A typical installation of the flexible gutter is shown in FIG. 2, wherein the gutter is installed on the underside of a concrete deck beneath an expansion joint 28. Self-tapping masonry screws 30 secure the flange shoulders 18 to the deck.

Referring to FIG. 3, for purposes of explanation the flexible gutter is shown as it would appear if it were laid out flat with the flanges 14 still in flat condition prior to bending. The dotted line 32 represents the fold line of the flanges, the portions on the membrane side of the fold line comprising the wall portions 16 of the flanges and the portions on the outer side of the fold line comprising the shoulder portions 18 of the flanges. When folded, the flanges would have the appearance of the flanges in FIGS. 1 and 2. As can be seen, the width of the membrane 12 is greater at the right side of FIG. 3 than at the left. When this configuration of gutter is installed on the undersurface of a deck 26, as shown in FIG. 4, so that the flanges are substantially evenly spaced apart, the extra amount of membrane 12 at the right side of FIG. 4 depends from the flanges 14 a greater distance that at the left side of FIG. 4, resulting in the pitch of the gutter running from left to right in the drawing.

As shown in FIG. 5, the gutter need not necessarily be provided with the outwardly extending shoulder portions of the flanges shown in FIGS. 1–4. The flanges 34 are similar to the wall portions 16 of flanges 14 of FIGS. 1–4 and are adapted to be attached to the deck 26 by means of support members 36. As illustrated, the flanges 34 are attached by fasteners 38 to angle support members 36. In the same manner as was done in connection with the gutter of FIGS. 3 and 4, the width of the membrane is made greater at one end of the gutter than the other so that the membrane hangs down from the flanges a greater distance where the width of material is greater, thus establishing the pitch of the gutter. By regulating the width of the membrane the desired pitch can be provided.

Referring to FIG. 6, another method of providing the desired pitch is illustrated. In this configuration, the membrane 12 is of constant width but the fold line 40 of flange 42 does not run parallel to the direction of the flanges. Instead it is angled so that the wall portion 44 of the flange 42 between the fold line 40 and the membrane 12 is wider at the right side of FIG. 6 than at the left side. Conversely, the shoulder portion 48 of the flange 42 between the fold line 40 and the outer edge of the flange is narrower at the right side of FIG. 6 than at the left side. When a gutter of this configuration is attached to a deck 26, as shown in FIG. 7, the wall portion 44 of flange 42 extends downwardly from the deck a greater distance at the right of FIG. 7 than at the left, thus establishing the pitch of the gutter as running toward the right.

Although the combined widths of the wall and shoulder portions of the flange are shown in FIG. 6 as being of constant dimension it is obvious that the shoulder portion could be made of constant width throughout its length to assure a great enough shoulder area for ready attachment to the underside of the deck. In this case, the combined widths would vary, being wider at one end of the gutter length than at the other. However, as long as the width of the wall portion of the flange varies as shown in FIG. 6, so that the distance it extends downwardly varies accordingly, the desired pitch can be designed into the gutter by controlling the critical dimensions.

FIG. 8 shows an arrangement for securing the flexible gutter in place beneath the juncture of a deck and a wall. Similar to the attaching means of FIG. 5, the membrane 12 carries on one elongated side a flange 34 which is connected by fastener 38 to support member 36 depending from the deck 26. The other elongated edge of membrane 12 is attached to a flange 50 which is attached by fastener 52 to wall 54. If desired, the edge of the membrane remote from the wall need not be attached to the deck in the manner of the attachment shown in FIG. 5, but could just as well be attached by the arrangement shown in FIG. 2. Any suitable means is acceptable, as long as the pitch of the gutter can be controlled either by varying the width of the membrane or by varying the height of the flange as explained previously.

In practice, a convenient way to supply the flexible gutter is in easily manageable lengths, such as ten feet long. When gutter runs of longer distances than that are required, the lengths must be connected. Any practical arrangement can be used, such as a butt joint or lap joint. One other arrangement is shown in FIGS. 9 and 10 wherein adjacent lengths of gutters are illustrated. In FIG. 9 it can be seen that membrane 12 extends beyond the end of the flange 14 of the gutter length at the right of the drawing to form extension 55. As shown in FIG. 10, this extension fits beneath and cradles the membrane at the end of the gutter at the left of the drawing so that the adjacent flanges abut and the adjacent membranes overlap. In such an arrangement the dimensions of the upper end of one gutter length should correspond to the dimensions of the lower end of the gutter length to which it is connected to provide continuity throughout the overall gutter run. By flashing the lapped joint with suitable material, such as uncured neoprene which when it cures will assume the shape of the underlying membrane and create a watertight joint, the ends of the gutter lengths can be quickly and effectively joined together. Although not shown, it is obvious that the gutter would be run to a downspout or a suitable collection arrangement.

Figure 12:
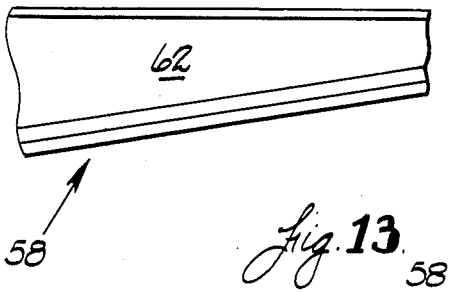
FIG. 12 is a partial side view of a sloped flange for supporting the gutter of FIG. 11.
Figure 11:
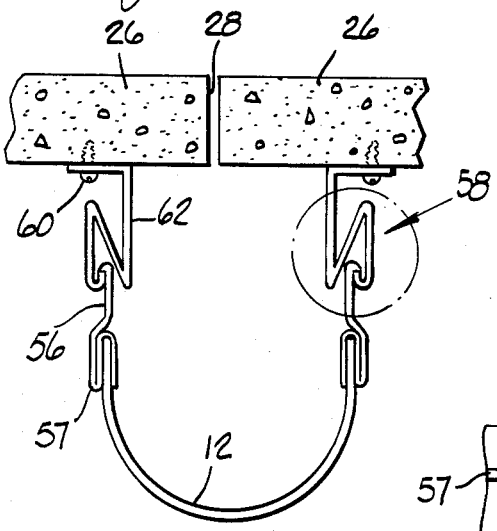
FIG. 11 is an end sectional view showing another embodiment of the flexible gutter attached to a concrete slab beneath an expansion joint.

Another convenient way to supply the flexible gutter is in much longer lengths, such as 50 feet, to allow for a simpler, faster installation of the system and resulting, in certain respects, in an improved system. Referring to FIG. 11, the flexible gutter of the present invention is shown located beneath expansion joint 28 of deck 26. The elongated edges of membrane 12 are connected to upwardly extending flanges 56 by means of the bifurcated clamp arrangement 57, similar to that shown in FIG. 1, and the flanges 56 are supported by angle supports 58 which are connected to the deck by fasteners 60. As shown in FIG. 12, the vertical wall portion 62 of angle support 58 is tapered so that the lower extremity of the angle support extends ever farther from the lower surface of the deck 26 in the downstream direction of the gutter. Thus the slope of the gutter is provided through use of a series of angle supports which are of lesser length than the relatively long, and thus preferably constant width, membrane. In practice, typical lengths for the membrane and angle supports would be 50 feet and 10 feet, respectively. The long membrane length, supplied in roll form, improves the integrity of the system by minimizing splices. It also allows the end fittings or down-pipe leaders at the end of the gutter to be of standard size rather than having to be specially engineered for each specific job. It should be understood that the vertical dimension of the upper end of one length of angle support would correspond to the vertical dimension of the lower end of the adjacent length of angle support to provide for a constant slope.

Figure 13:
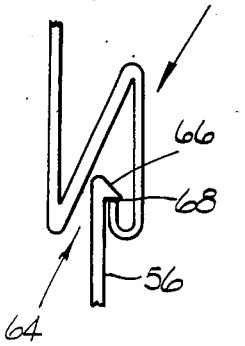
FIG. 13 is an enlarged view of the portion of FIG. 11 enclosed by the broken circle.
Figure 14:
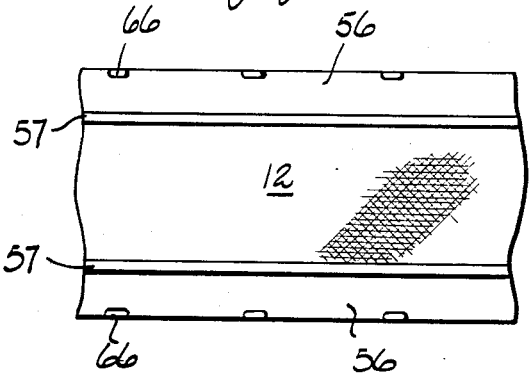
FIG. 14 is a partial plan view of the flexible gutter of FIG. 11 as it would appear lying flat on a surface prior to installation.

Note that the folded portion of the lower part of the angle support 58 is not tightly folded as in the case of the clamp attachment of flange 56 to the elongated edge of the membrane 12, but is formed in a general Z-configuration which has an open slot 64, more clearly shown in the enlarged view of FIG. 13. The upper portion of the flange 56 is adapted to fit into the slot 64, as by snapping the flange into place against the resilient fold, and small tabs 66, struck from the flange 56 at spaced locations along the outer edge thereof, form shoulder portions which are supported by the upturned end 68 of the Z-configuration. The spaced tabs are further shown in FIG. 14, wherein the membrane 12 and attached flanges 56 are shown as they would appear lying open on a flat surface prior to being installed. Obviously, other specific designs of the attachment means between the flange 56 and the angle support 62 could be provided as long as they enable the long length of membrane to be readily manipulated into place and permit a relatively quick attachment of the flange to the angle supports.

Although described in connection with leaks in concrete decks or slabs, the flexible gutter of the present invention is useful in other environments as well. Obviously, in any situation where there is leakage or collection of unwanted moisture and a full repair of the roof or floor involved is not warranted, the flexible gutter of the present invention should be considered as a remedy. Examples of such other situations are roof leaks, under the joint where a parking or roof deck abuts a wall, drips from condensation on ceilings and pipes, and as a safety drain for chemical spills.

It should now be appreciated that the present invention provides a simple, inexpensive yet highly effective solution to the problem of repairing or controlling leaks under decks where the leaks are anticipated or have actually occurred. The flexible gutter allows for convenient handling and shipping and is easy for workmen to install. By controlling the dimensions of the components the pitch of the gutter for any particular job can be predetermined and formed into the gutter lengths produced for that job. Thus the invention permits factory controlled custom jobs to be undertaken.

It should be obvious that although preferred embodiments of the invention have been described, changes to certain specific details can be made without departing from the spirit and scope of the invention as defined in the claims.

What is claimed is:

1. In a construction for collecting moisture from the underside of a generally horizontal surface including an elongated gutter having a flexible trough comprised of a waterproof membrane; an improvement comprising means for securing the gutter in place beneath the generally horizontal surface at a location to collect moisture dripping from the surface, said securing means including rigid flanges for attaching to the elongated edge portions of the membrane and means for attaching the flanges to the generally horizontal surface, each of said flanges having a wall portion depending downwardly away from the horizontal surface such that the combined width of the membrane and the two depending wall portions is greater downstream of the gutter length than upsteam of the gutter length, wherein the width of the membrane is substantially uniform along the length of the gutter, and the wall portions of the flanges extend upwardly from the elongated edge portions of the membrane a greater distance downstream of the gutter length than upstream of the gutter length to provide the slope of the gutter, thereby enabling the bottom of the trough to be sloped when the gutter is installed so that moisture collecting in the trough bottom will be directed or drained away by the action of gravity.

2. A construction according to claim 1, wherein the means for securing the gutter in place beneath the generally horizontal surface comprises means for attaching one of the flanges to an adjacent wall.

3. A construction according to claim 1, wherein the flanges are spaced generally uniformly apart.

4. A construction according to claim 1, wherein the flange walls are attached to a vertical support to secure the gutter in place.

5. A construction according to claim 1, wherein the flanges include shoulders extending outwardly from the wall portions at substantially right angles thereto, the flange shoulders being attached to a horizontal support to secure the gutter in place.

6. A construction according to claim 5, wherein the horizontal support is a cementitious slab and the flange shoulders are attached to the slab by masonry fasteners.

7. A construction according to claim 4, wherein the flanges include shoulders supported on horizontal ledges integral with the vertical support.

8. A construction according to claim 7, wherein the shoulders are tabs integral with and struck from the flanges.

9. A construction according to claim 7, wherein the waterproof membrane is relatively long and the vertical support containing the horizontal ledges is comprised of a plurality of relatively short lengths of individual vertical supports, whereby a length of membrane is connected to a plurality of lengths of vertical support members.

10. A construction according to claim 1, wherein the gutter is comprised of a plurality of gutter lengths connected together to form a continuous watertight length of drainage gutter.

11. A construction according to claim 1, wherein the membrane is comprised of neoprene.

12. A flexible drainage gutter according to claim 1, wherrein the elongated edge portions of the membrane are received in clamped bifurcated joints in the wall portions of the flanges.

* * * * *